US006645315B2

(12) United States Patent
Chomer et al.

(10) Patent No.: US 6,645,315 B2
(45) Date of Patent: Nov. 11, 2003

(54) SURFACE TREATMENT PROCESS FOR MECHANICAL PARTS SUBJECT TO WEAR AND CORROSION

(75) Inventors: Stéphane Chomer, Aveize (FR); Stephan Teil, Oullins (FR)

(73) Assignee: Centre Stephanois de Recherches Mecaniques Hydromecanique et Frottement, Andrezieux-Boutheon (FR)

( * ) Notice: Subject to any disclaimer, the term of this patent is extended or adjusted under 35 U.S.C. 154(b) by 0 days.

(21) Appl. No.: 09/923,044

(22) Filed: Aug. 6, 2001

(65) Prior Publication Data

US 2002/0038679 A1 Apr. 4, 2002

(30) Foreign Application Priority Data

Aug. 14, 2000 (FR) ..... 00 10633

(51) Int. Cl.[7] ..... C23C 8/76
(52) U.S. Cl. ..... 148/217
(58) Field of Search ..... 148/217; 427/435

(56) References Cited

U.S. PATENT DOCUMENTS 3,912,547 A * 10/1975 Gaucher et al. ..... 148/218
5,346,560 A * 9/1994 Mournet et al. ..... 148/217
6,328,818 B1 * 12/2001 Miyagi et al. ..... 148/209

FOREIGN PATENT DOCUMENTS

| | | | | |
|---|---|---|---|---|
| DE | 1149035 B | | 5/1963 | |
| DE | 4119820 C1 | | 9/1992 | |
| EP | 0524 037 A1 | | 1/1993 | |
| JP | 57152461 | | 9/1982 | |
| JP | 08020877 A | * | 1/1996 | ..... C23C/22/62 |

* cited by examiner

*Primary Examiner*—John Sheehan
(74) *Attorney, Agent, or Firm*—Morgan & Finnegan, L.L.P.; Israel Blum, Esq.

(57) ABSTRACT

In a surface treatment process for mechanical parts, for conferring on the parts a high resistance to wear and corrosion and a roughness propitious to lubrication, nitriding of the part is followed consecutively by oxidation of the part. The nitriding is applied by immersing the part in a molten salt nitriding bath free of sulfur-containing species at a temperature from approximately 500° C. to approximately 700° C. The oxidation is carried out in an oxidizing aqueous solution at a temperature less than approximately 200° C.

19 Claims, No Drawings

SURFACE TREATMENT PROCESS FOR MECHANICAL PARTS SUBJECT TO WEAR AND CORROSION

BACKGROUND OF THE INVENTION

1. Field of the Invention

The present invention relates to a surface treatment process for mechanical parts subject to wear and corrosion. The invention relates more particularly to a surface treatment process for mechanical parts subject to wear and corrosion which confers on said parts a high resistance to wear and corrosion and a roughness propitious to lubrication. To be even more precise, the invention relates to a surface treatment process for mechanical parts whose lubrication must be precisely controlled and whose roughness must consequently be controlled within a narrow range.

2. Description of the Prior Art

The thickness of the oil film on the surface of a part depends greatly on the roughness of its surface, as is well known in the art: a part that is perfectly polished may not be wetted by the oil whereas, conversely, a very rough part will be covered with a film whose thickness is less than the height of the microreliefs, resulting in a high risk of binding.

Parts that can advantageously be treated in accordance with the present invention include piston rods and internal combustion engine valves, for example. With regard to a piston rod, the thickness of the oil film on its surface must be perfectly controlled; if it is too thin, the rod-seal contact is no longer lubricated and wear occurs; if it is too thick, the resulting leakage of lubricant degrades performance. With regard to an internal combustion engine valve, the oil film fulfills lubrication and dynamic sealing functions in the area of contact between the valve stem and the valve guide; a part that is too highly polished will produce a thin oil film and lubrication will be random, whereas high roughness will lead to high oil consumption and loss of engine efficiency.

Many solutions are available to the skilled person when faced with a member that must resist wear and corrosion. Thus it is standard practice to use thick deposits of "hard chromium" with microcracks. These deposits have drawbacks, however. From the technical point of view, the presence of an interface between the steel and the chromium may give rise to dramatic scaling in the intended functions; moreover, in the case of parts that operate intermittently, such as some piston-and-cylinder devices, there is a risk of elimination of the residual film of lubricant by inclement weather and therefore of corrosion. From the economic point of view, the above process necessitates deposition followed by machining, which makes it a costly solution. Finally, from the environmental point of view, chromium-plating is still very widely practiced using baths containing chromium VI, which is a major pollutant.

Another solution that is widely used consists in nitriding the parts and then oxidizing them; these two operations are often followed by a step of impregnating the surface pores with a product further improving corrosion resistance. The above operations are carried out in succession, either in a salt bath, as disclosed in French patent FR-A-2 672 059 or U.S. Pat. No. 5,346,560, for example, or in a gaseous atmosphere, as disclosed in European patent 0217420, for example.

The combined operation of nitriding and oxidation generally imparts a very high resistance to wear and corrosion, but systematically increases the surface roughness of the part, to a degree that is incompatible with what is required for the applications to which the invention relates.

This increase in roughness leads the skilled person to add to the above processes one or more phases of more or less extensive polishing, yielding sequences such as nitriding-oxidation-polishing or even nitriding-oxidation-polishing-oxidation. Processes of this kind fulfill the lubrication function effectively, but are difficult to apply industrially because they require a combination of different technologies (thermochemical and mechanical), which makes them both very costly and of limited application; it is difficult to control the roughness of a part of complex shape by polishing.

Surprisingly, we have shown that it is possible to obtain high wear and corrosion resistance and a roughness propitious to lubrication by carrying out the nitriding and oxidation operations in particular baths.

SUMMARY OF THE INVENTION

The objects defined above are met by the present invention, which provides a surface treatment process for mechanical parts, for conferring on said parts a high resistance to wear and corrosion and a roughness propitious to lubrication, in which process nitriding of said part is followed consecutively by oxidation of said part, said nitriding is applied by immersing said part in a molten salt nitriding bath free of sulfur-containing species at a temperature from approximately 500° C. to approximately 700° C., and said oxidation is carried out in an oxidizing aqueous solution at a temperature less than approximately 200° C.

To conform to the invention, the process must also conform to a consecutive association of nitriding and oxidation, which two operations are carried out in the liquid phase under the conditions specified above.

However, it is not a question of consecutive association of a particular nitriding process and a particular oxidation process, but rather of an inseparable combination of nitriding and oxidation processes because, in the process according to the invention, there is a very high level of interaction between them.

The two steps of the process, namely the nitriding step and the oxidation step, must conform to the following conditions:

(1) The first step (the nitriding operation) must be executed in a molten bath free of sulfur-containing species.

The temperature of the bath is from approximately 500° C. to approximately 700° C., for example from approximately 590° C. to approximately 650° C.

The bath advantageously includes alkaline carbonates and cyanates and has the following composition:

$Li^+$=0.2–10 wt %

$Na^+$=10–30 wt %

$K^+$=10–30 wt %

$CO_3^{2-}$=25–45 wt %

$CNO^-$=10–40 wt %

$CN^-$<0.5 wt %

For example, the molten salt nitriding bath contains the following ions:

$Li^+$=2.8–4.2 wt %

$Na^+$=16.0–19.0 wt %

$K^+$=20.0–23.0 wt %

$CO_3^{2-}$=38.0–43.0 wt %

$CNO^-$=12.0–17.0 wt % with a quantity of $CN^-$ ions of not more than 0.5 wt %.

Agitation by compressed air is advantageously provided.

The time of immersion of the parts is advantageously at least approximately 10 minutes; it can be extended up to several hours, depending on what is required. The time of immersion of the parts is usually from about 30 minutes to about 60 minutes.

(2) The second step (the oxidation operation), after nitriding, must be carried out at a temperature less than approximately 200° C. The temperature of the oxidation bath is preferably from approximately 110° C. to approximately 160° C. The temperature of the oxidation bath is even more preferably from approximately 125° C. to approximately 135° C.

The composition of the bath is advantageously as follows:

$OH^-$=10.0–22 wt %

$NO_3^-$=1.8–11.8 wt %

$NO_2^-$=0–5.3 wt %

$S_2O_3^{2-}$=0.1–1.9 wt %

$Cl^-$=0–1.0 wt %

$Na^-$=1.0–38 wt %

For example, the oxidizing aqueous solution contains the following ions:

$OH^-$=17–18.5 wt %

$NO_3^-$=4.0–5.5 wt %

$NO_2^-$=1.0–2.5 wt %

$Cl^-$=0.25–0.35 wt %

$Na^+$=25–29 wt %

For example, the oxidizing aqueous solution further contains 0.6 to 1.0 wt % of thiosulfate ions $S_2O_3^{2-}$.

The time of immersion of the parts in the oxidation bath is advantageously from approximately 5 minutes to approximately 45 minutes.

It is noteworthy that, after being nitrided and then oxidized in accordance with the invention, the parts treated can then undergo an impregnation operation as effectively as in the prior art. Although the final roughness is much lower, the affinity of the layer for impregnation products is at least as high. This surprising fact has as yet to be explained scientifically.

The invention also provides a part treated by the above process, in which said process has caused surface modifications. A part according to the invention is characterized in that its roughness $R_a$ has a value less than approximately 0.5 μm and in that its surface is free of "tables".

DETAILED DESCRIPTION OF THE PREFERRED EMBODIMENTS

The invention is described next in more detail by means of the following non-limiting examples.

EXAMPLE 1

Parallelepiped-shaped samples with dimensions of 30×18×8 mm and 35 mm diameter rings, both of non-alloy steel containing 0.35% carbon and having an initial roughness $R_{max}$=0.6 μm, were treated first in a nitriding salt bath containing 19 wt % of cyanate ions, 37 wt % of carbonate ions and 3.5 wt % of lithium ions, the remainder consisting of sodium and potassium ions. The parts were immersed for 40 minutes at 630° C.

On leaving the bath, the parts were cooled in a tank of water and then washed before being immersed for 15 minutes in oxidizing brine at 135° C. consisting of 85 kg of the following mixture of salts (see table I) per 75 liters of water:

TABLE I

| | |
|---|---|
| $OH^-$ | 18 wt % |
| $NO_2^-$ | 2 wt % |
| $NO_3^-$ | 5 wt % |
| $S_2O_3^{2-}$ | 1 wt % |
| $Cl^-$ | 0.3 wt % |
| $Na^+$ | 27 wt % |

The parts were then washed in water at 80° C. and then neutralized in a solution based on soluble oil at 40° C. before they were dried.

The samples were characterized by measuring their roughness and by friction tests.

The measured roughness of the parts treated as above is set out in table II, where it is compared to those obtained with the standard methods N1, N2, Ox1 and Ox2, N1 corresponding to nitriding in accordance with FR 72 05 498, N2 to nitriding in accordance with (TF1), Ox1 to oxidation according to FR 93 09814 and Ox2 to oxidation according to FR 76 07858. The morphological parameters of the roughness patterns used to qualify the surface states are denoted $R_a$ (length arithmetic mean) and R (depth arithmetic mean).

TABLE II

| | | BEFORE TREATMENT | | AFTER TREATMENT | |
|---|---|---|---|---|---|
| TREATMENT | | R (μm) | $R_a$ (μm) | R (μm) | $R_a$ (μm) |
| N2 + Ox2 | UNPOLISHED | 0.25 | 58 | 2.3 | 62 |
| | POLISHED | 0.25 | 58 | 0.9 | 54 |
| N3 + Ox3 | UNPOLISHED | 0.25 | 58 | 2.5 | 66 |
| | POLISHED | 0.25 | 58 | 0.9 | 56 |
| N1 + Ox3: treatment according to the invention | | 0.25 | 58 | 0.85 | 52 |

Note that the process according to the invention obtains a roughness equivalent to that of the conventional methods followed by polishing.

For the friction tests, the ring was pressed against the large face of the plate with a load regularly increased from an initial value of 5 daN and at a constant sliding speed of 0.55 m/s. The rubbing surface of the plate was oiled before the test. The results are set out in table III.

TABLE III

| Treatment | | Duration of test (min) | Cumulative wear of two parts (μm) | Coefficient of friction |
|---|---|---|---|---|
| N2 + Ox2 | Without polishing | 30 | 30 | 0.4 |
| | After polishing | 60 | 12 | 0.25 |
| N3 + Ox3 | Without polishing | 30 | 34 | 0.43 |
| | After polishing | 50 | 20 | 0.3 |
| N1 + Ox1: treatment according to the invention | | 60 | 10 | 0.2 |

EXAMPLE 2

Cylinders of high-alloy steel containing 0.45% carbon, 9% chromium and 3% silicon were treated in a nitriding bath having exactly the same composition as that of example 1.

The parts were immersed for 30 minutes in the bath maintained at a temperature of 590° C. and then quenched in cold water. After washing them, they were oxidized in the brine described in example 1 for 10 minutes at 130° C. and then washed again with hot water.

With this type of steel, the roughness obtained with the standard carbonitriding+oxidation or sulfo-carbonitriding+oxidation processes is relatively high because of the poor quality of the surface layers obtained (very porous layers and poorly adherent oxide powder). For example, the value of $R_z$ is usually of the order of 10 μm and it is often necessary to carry out a polishing operation, or even microshotblasting, to reduce the roughness $R_z$ to the vicinity of 2 μm.

The samples treated under the conditions defined for this example had a roughness $R_z$ from 2 to 2.5 μm without requiring any polishing or microshotblasting.

Note: $R_z$ is the average roughness depth as per French standard NF ISO 4287 of 1997, corrected 1998.

EXAMPLE 3

Tests were carried out to show the degree to which the process according to the invention constitutes an inseparable combination. Cylindrical samples of non-alloy steel containing 0.35 wt % carbon were treated by associating various nitriding methods with the usual oxidation methods, including that cited in examples 1 and 2.

The nitriding step was carried out either according to FR 72 05498 at 570° C. in a salt bath consisting of 37 wt % of cyanate ions and 17 wt % of carbonate ions, the remainder being alkaline $K^+$, $Na^+$ and $Li^+$ cations, with additionally 10 to 15 ppm of $S^{2-}$ ions, or under the same conditions as those for example 1.

The oxidation step was carried out either in accordance with FR 9309814 at 475° C. in a salt bath based on 13.1 wt % of carbonate ions, 36.5 wt % of nitrate ions, 11.3 wt % of hydroxide ions and 0.1 wt % of bichromate ions, the remainder consisting of alkaline $K^+$, $Na^+$ and $Li^+$ cations, or under the conditions described for examples 1 and 2.

The roughness results obtained are set out in table IV below; the initial roughness $R_a$ for all the samples was 0.3 μm.

TABLE IV

| | ROUGHNESS AFTER TREATMENT | |
|---|---|---|
| TREATMENT | R (μm) | $R_a$ (μm) |
| N2 570° C. + Ox2 475° C. | 2.3 | 62 |
| N2 570° C. + Ox1 130° C. | 2.6 | 66 |
| N1 630° C. + Ox2 475° C. | 2.4 | 63 |
| N1 570° C. + Ox1 130° C. | 0.9 | 54 |
| N1 630° C. + Ox1 130° C. according to the invention | 0.85 | 52 |
| N1 570° C. + Ox1 110° C. | 0.9 | 55 |
| N1 590° C. + Ox1 150° C. according to the invention | 0.85 | 51 |

What is claimed is:

1. A surface treatment process for mechanical parts, for conferring on said parts a high resistance to wear and corrosion and a roughness propitious to lubrication, in which process nitriding of said part is followed consecutively by oxidation of said part, said nitriding is applied by immersing said part in a molten salt nitriding bath free of sulfur-containing species at a temperature from approximately 500° C. to approximately 700° C., and said oxidation is carried out in an oxidizing aqueous solution at a temperature less than approximately 200° C., wherein said nitriding bath contains the following ions:

$Li^+$=2.8–4.2 wt %;

$Na^+$=16.0–19.0 wt %;

$K^+$=20.0–23.0 wt %;

$CO_3^{2-}$=38.0–43.0 wt %;

$CNO^-$=12.0–17.0 wt %; and with a quantity of $CN^-$ not greater than 0.5 wt %.

2. The process claimed in claim 1, wherein said mechanical part is immersed in said nitriding bath for at least approximately 10 minutes.

3. The process claimed in claim 2, wherein said mechanical part is immersed in said nitriding bath for from approximately 30 minutes to approximately 60 minutes.

4. The process claimed in claim 1, wherein said nitriding bath is agitated with compressed air.

5. The process claimed in claim 1, wherein said oxidizing aqueous solution contains the following ions:

$OH^-$=10.0–22.0 wt %;

$NO_3$=1.8–11.8 wt %;

$NO_2$=0–5.3 wt %;

$Cl^-$=0–1.0 wt %; and $Na^{30}$ =1.0–38 wt %.

6. The process claimed in claim 1, wherein said nitriding is carried out at a temperature from approximately 590° C. to approximately 650° C.

7. A surface treatment process for mechanical parts, for conferring on said parts a high resistance to wear and corrosion and a roughness propitious to lubrication, in which process nitriding of said part is followed consecutively by oxidation of said part, said nitriding is applied by immersing said part in a molten salt nitriding bath free of sulfur-containing species at a temperature from approximately 500° C. to approximately 700° C., and said oxidation is carried out in an oxidizing aqueous solution at a temperature less than approximately 200° C., wherein said oxidizing aqueous solution contains the following ions:

$OH^-$=17–18.5 wt %;

$NO_3^-$=4.0–5.5 wt %;

$NO_2^-$=1.0–2.5 wt %;

$Cl^-$=0.25–0.35 wt %; and $Na^+$=25–29 wt %.

8. A surface treatment process for mechanical parts, for conferring on said parts a high resistance to wear and corrosion and a roughness propitious to lubrication, in which process nitriding of said part is followed consecutively by oxidation of said part, said nitriding is applied by immersing said part in a molten salt nitriding bath free of sulfur-containing species at a temperature from approximately 500° C. to approximately 700° C., and said oxidation is carried out in an oxidizing aqueous solution at a temperature less than approximately 200° C., said molten salt nitriding bath contains the following ions:

$Li^+$=0.2–10 wt %;

$Na^+$=10–30 wt %;

$K^+$=10–30 wt %;

$CO_3^{2-}$=25–45 wt %; and $CNO^-$=10–40 wt %;

with a quantity of $CN^-$ ions not greater than 0.5 wt %, wherein said oxidizing aqueous solution contains the following ions:

$OH^-$=10.0–22.0 wt %;

$NO_3^-$=1.8–11.8 wt %;

$NO_2^-$=0–5.3 wt %;

$Cl^-$=0–1.0 wt %; and $Na^+$=1.0–38 wt %.

9. The process claimed in claim 8, wherein said oxidizing aqueous solution further contains 0.1 to 1.9 wt % of thiosulfate ions $S_2O_3^{2-}$.

10. The process claimed in claim 9, wherein said oxidizing aqueous solution further contains 0.6 to 1.0 wt % of thiosulfate ions $S_2O_3^{2-}$.

11. The process claimed in claim 8, wherein said oxidation is carried out at a temperature from approximately 100° C. to approximately 160° C.

12. The process claimed in claim 11, wherein said oxidation is carried out at a temperature from approximately 125° C. to approximately 135° C.

13. The process claimed in claim 8, wherein said part is immersed in said oxidizing bath for from approximately 5 minutes to approximately 45 minutes.

14. The process claimed in claim 8, wherein said molten salt nitriding bath conditions contains the following ions:

$Li^+$=2.8–4.2 wt %;

$Na^+$=16.0–19.0 wt %;

$K^+$=20.0–23.0 wt %;

$CO_3^{2-}$=38.0–43.0 wt %;

$CNO^-$=12.0–17.0 wt %; and with a quantity of $CN^-$ ions not greater than 0.5 wt %.

15. The process claimed in claim 8, wherein said mechanical part is immersed in said nitriding bath for at least approximately 10 minutes.

16. The process claimed in claim 15, wherein said mechanical part is immersed in said nitriding bath for from approximately 30 minutes to approximately 60 minutes.

17. The process claimed in claim 8, wherein said nitriding bath is agitated with compressed air.

18. The process claimed in claim 8, wherein said oxidizing aqueous solution contains the following ions:

$OH^-$=17–18.5 wt %;

$NO_3^-$=4.0–5.5 wt %;

$NO_2^-$=1.0–2.5 wt %;

$Cl^-$=0.25–0.35 wt %; and $Na^+$=25–29 wt %.

19. The process claimed in claim 8, wherein said nitriding is carried out at a temperature from approximately 590° C. to approximately 650° C.

* * * * *